US012392048B2

(12) United States Patent
Akyil et al.

(10) Patent No.: US 12,392,048 B2
(45) Date of Patent: Aug. 19, 2025

(54) METHOD FOR PRODUCING A CORROSION-RESISTANT ALUMINUM-SILICON ALLOY CASTING, SUCH CORROSION-RESISTANT ALUMINUM-SILICON ALLOY CASTING AND ITS USE

(71) Applicant: COVENTYA GMBH, Gütersloh (DE)

(72) Inventors: Can Akyil, Istanbul (TR); Pinar Afsin, Istanbul (TR); Güney Akdas, Istanbul (TR); Michael Krumm, Bielefeld (DE)

(73) Assignee: COVENTYA GMBH, Gütersloh (DE)

( * ) Notice: Subject to any disclaimer, the term of this patent is extended or adjusted under 35 U.S.C. 154(b) by 418 days.

(21) Appl. No.: 17/430,045

(22) PCT Filed: Feb. 13, 2020

(86) PCT No.: PCT/EP2020/053715
§ 371 (c)(1),
(2) Date: Aug. 11, 2021

(87) PCT Pub. No.: WO2020/165319
PCT Pub. Date: Aug. 20, 2020

(65) Prior Publication Data

US 2022/0136127 A1 May 5, 2022

(30) Foreign Application Priority Data

Feb. 15, 2019 (EP) ..... 19157520

(51) Int. Cl.
*C25D 11/12* (2006.01)
*C25D 11/08* (2006.01)
(Continued)

(52) U.S. Cl.
CPC ..... *C25D 11/12* (2013.01); *C25D 11/08* (2013.01); *C25D 11/10* (2013.01); *C25D 11/16* (2013.01); *C25D 11/246* (2013.01)

(58) Field of Classification Search
None
See application file for complete search history.

(56) References Cited

U.S. PATENT DOCUMENTS 2,897,125 A * 7/1959 Franklin ..... C25D 11/08 205/327
6,027,629 A 2/2000 Hisamoto et al.
(Continued)

FOREIGN PATENT DOCUMENTS

CN 101724880 A 6/2010
CN 102433578 A 5/2012
(Continued)

OTHER PUBLICATIONS

Translation—CN-103484916-A; Ji J; Jan. 2014 (Year: 2014).*
(Continued)

*Primary Examiner* — Daniel J. Schleis
(74) *Attorney, Agent, or Firm* — Carmody Torrance Sandak & Hennessey LLP

(57) ABSTRACT

The present invention is related to the field of metal surface preparation by anodizing processes and refers to a method for producing a corrosion-resistant aluminum-silicon alloy casting and more particularly to the optimization of the anodizing cast aluminum parts with high silicon content, by using a multiple step anodizing cycle. Moreover, the present invention refers to a corrosion-resistant aluminum-silicon alloy casting and its use.

22 Claims, 4 Drawing Sheets

Figure 1:
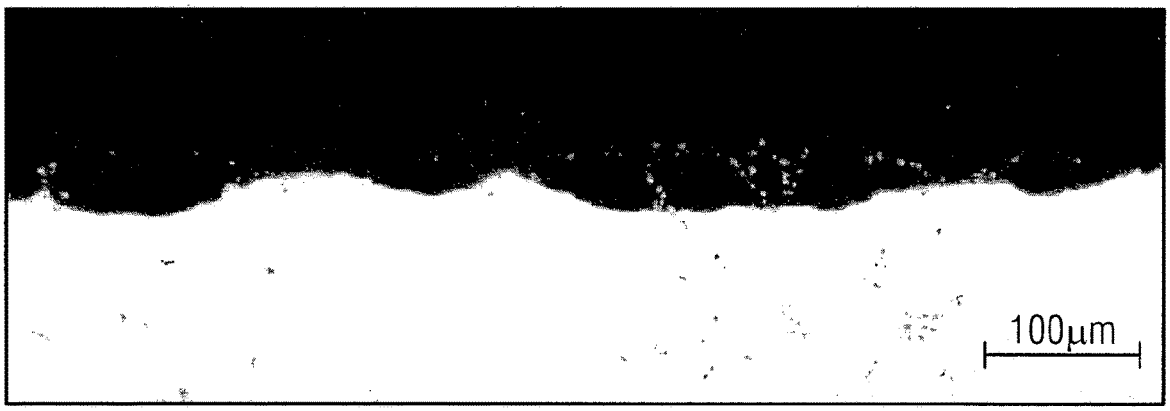
Figure 1:
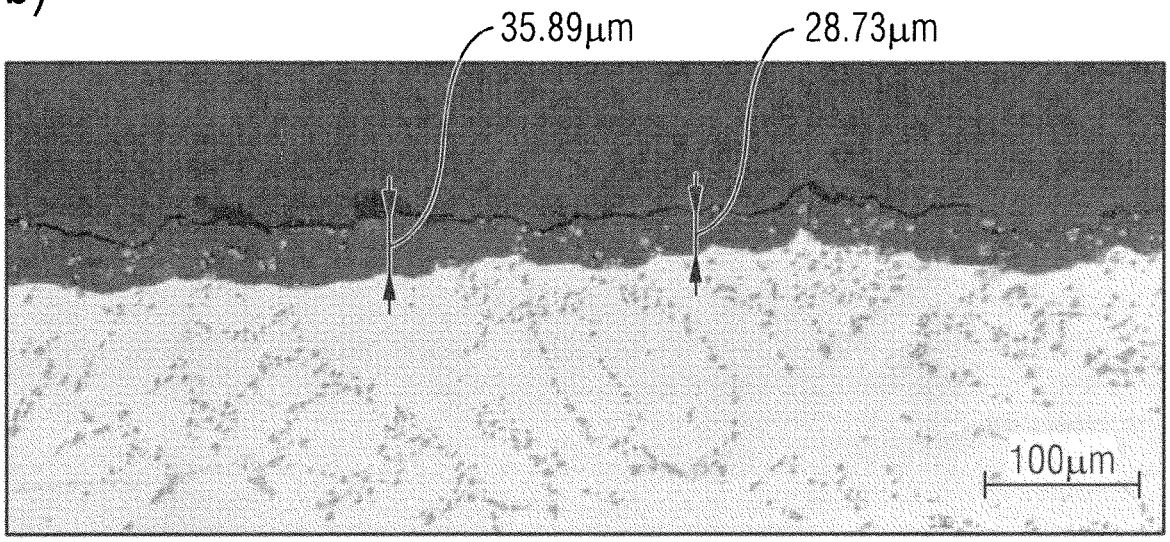

(51) Int. Cl.

| | |
|---|---|
| ***C25D 11/10*** | (2006.01) |
| ***C25D 11/16*** | (2006.01) |
| ***C25D 11/24*** | (2006.01) |

(56) References Cited

U.S. PATENT DOCUMENTS

| | | | | |
|---|---|---|---|---|
| 6,040,059 | A | 3/2000 | Birkner et al. | |
| 2006/0021683 | A1 | 2/2006 | Lin et al. | |
| 2008/0160846 | A1 | 7/2008 | Kitsunai et al. | |
| 2009/0038946 | A1 | 2/2009 | Ohmi et al. | |
| 2012/0048390 | A1* | 3/2012 | Nasserrafi | C21D 7/06 301/124.1 |
| 2014/0262790 | A1* | 9/2014 | Levendusky | C25D 11/246 205/112 |
| 2016/0068947 | A1 | 3/2016 | Jennings et al. | |
| 2016/0068967 | A1* | 3/2016 | Jennings | C09D 5/08 427/559 |
| 2016/0115614 | A1 | 4/2016 | Kim et al. | |

FOREIGN PATENT DOCUMENTS

| | | | | | |
|---|---|---|---|---|---|
| CN | 103215629 | A | | 7/2013 | |
| CN | 103484737 | A | | 1/2014 | |
| CN | 103484916 | A | * | 1/2014 | |
| CN | 104846413 | A | | 8/2015 | |
| CN | 103484916 | B | * | 5/2016 | B22D 17/00 |
| CN | 107980187 | A | | 5/2018 | |
| EP | 0792951 | A1 | | 9/1997 | |
| EP | 1 774 067 | B1 | | 3/2016 | |
| GB | 1097356 | A | | 1/1968 | |
| JP | S46-013127 | B1 | | 4/1971 | |
| JP | S50-112234 | A | | 9/1975 | |
| JP | H07-126891 | A1 | | 5/1995 | |
| JP | H08144088 | A | | 6/1996 | |
| JP | 2000027993 | A | | 1/2000 | |
| KR | 101751377 | B1 | | 6/2017 | |
| KR | 1020170092209 | A | | 8/2017 | |
| KR | 101794583 | B1 | | 11/2017 | |
| WO | 2009077146 | A1 | | 6/2009 | |
| WO | WO 2017/089687 | A1 | | 6/2017 | |

OTHER PUBLICATIONS

Fratila-Apachitei et al., "AlSi(Cu) anodic oxide layers formed in H2SO4 at low temperature using different current waveforms," *Surface and Coatings Technology* 165: 232-240 (2003).

Gastón-García et al., "Sulphuric acid anodizing of EN AC-46500 cast aluminum alloy," *Transactions of the Institute of Metal Finishing* 89(6): 312-319 (2011).

European Patent Office, Extended European Search Report in European Patent Application No. 19 15 7520 (Aug. 6, 2019).

European Patent Office, International Search Report in International Application No. PCT/EP2020/053715 (May 18, 2020).

European Patent Office, Written Opinion in International Application No. PCT/EP2020/053715 (May 18, 2020).

International Bureau of WIPO, International Preliminary Report on Patentability in International Application No. PCT/EP2020/053715 (Aug. 10, 2021).

Mnghuai, Mao. "Industrial Pollution Accounting (2nd Edition)", China Environment Publishing House, Beijing. (2024) (English Translation).

* cited by examiner a)

b)

a)

10kV X500 50μm 13 60 BES b)

10kV X500 50μm 14 60 BES c)

10kV X500 50μm 13 60 BES d)

10kV X500 50μm 11 60 BES a)

15kV X100 100μm 15 52 BES b)

15kV X100 100μm 17 55 BES c)

15kV X100 100μm 15 48 BES d)

15kV X100 100μm 17 48 BES a)

b)

c)

d)

METHOD FOR PRODUCING A CORROSION-RESISTANT ALUMINUM-SILICON ALLOY CASTING, SUCH CORROSION-RESISTANT ALUMINUM-SILICON ALLOY CASTING AND ITS USE

CROSS-REFERENCE TO RELATED APPLICATIONS

This patent application is the U.S. national phase of International Application No. PCT/EP2020/053715, filed on Feb. 13, 2020, which claims the benefit of European Patent Application No. 19157520.8, filed Feb. 15, 2019, the disclosures of which are incorporated herein by reference in their entireties for all purposes.

The present invention is related to the field of metal surface preparation by anodizing processes and refers to a method for producing a corrosion-resistant aluminum-silicon alloy casting and more particularly to the optimization of the anodizing cast aluminum parts with high silicon content, by using a multiple step anodizing cycle. Moreover, the present invention refers to a corrosion-resistant aluminum-silicon alloy casting and its use.

Nowadays, due to its excellent weight to strength ratio, aluminum tends to find itself new industries as area of usage, especially in automotive industry more than ever. Automotive companies, trying to reduce weight for reduced greenhouse gas emissions, tend to use aluminum alloys. Furthermore weight reduction is also one of the critical goals for the electric mobility, which is strongly limited by the capacity of the current batteries. In order to pass the deficit of the shorter range of the electric cars caused by the current battery technology the weight reduction is the key to overcome this obstacle.

Cast aluminum alloys, rich in intermetallics, are one of the types utilized most especially in automotive applications to replace steel parts. However, aluminum, like all the other metals becomes susceptible to corrosion (especially pitting corrosion) in the presence of aggressive ions. The intermetallics, act as galvanic couples under the oxide film and initiates the pitting phenomenon. Therefore pitting and other localized corrosion forms is a real problem for cast alloys due to their segregated structure and alloying element content with various chemical composition.

Among the most effective and common ways for improving the corrosion resistance of aluminum is the "anodic oxidation" process, which is to increase the thickness of the oxide layer on the aluminum. Anodizing is an electrochemical process applied mainly to aluminum, magnesium and titanium. During the process, the thickness of the inherent oxide film on the base metal is increased, thus enhancing the surface properties. The concept anodizing relies on applying anodic potentials to the substrate, hence favoring dissolution of the surface. However, the potential exerted shifts the reference potential on the surface towards passivation, hence creating an environment suitable for the oxide film to grow.

One of the biggest challenges of anodization is the content of foreign materials namely alloying elements. During the dissolution of aluminum they tend to disrupt the process. One of the most negatively influential alloying element on anodizing efficiency and quality is the silicon content. Silicon due to its inert and low conducting nature acts like a barrier on the substrate surface and impedes the oxide growth. This problem becomes especially potent with the high silicon alloys, in which the silicon is added for increasing the castability with die casting processes. The silicon due to its relatively inert nature prevents the aluminum oxide from growing thus creating areas without anodic oxide film and also limiting the oxide film thickness. Once the process is finished these empty zones with silicon secondary phases in the center create cathodic zones in the discontinuous anodic oxide film and enhance the pitting corrosion problem during service life.

EP1774067B1 discloses a method and a composition of anodizing by the micro-arc oxidation process especially of surfaces of magnesium, magnesium alloys, aluminum, aluminum alloys or these mixtures or of surfaces or surfaces' mixtures containing such metallic materials. This patent does not address the problem of pitting and how to obtain a uniform oxide film.

WO2017/089687 discloses a process for the continuous treatment of an aluminum alloy strip comprising a step of forming a chemical conversion coating on the surface of the strip by a reaction with a chemical conversion treatment agent. This document teaches further different metals to form a coating on the surface of the aluminum alloy generating additional cost.

L. E. Fratila-Apachitei et al. 2003 discloses different techniques of anodic oxidation of Al, $AlSi_{10}$ and $AlSi_{10}Cu_3$ using different current waveforms (i.e. square, ramp-square, ramp-down and ramp-down spike).

None of those prior art documents disclose a method to obtain an uniform aluminum oxide film that could protect against corrosion issues.

It was therefore the posed problem of the present invention to provide an aluminum alloy substrate with improved corrosion resistance.

This problem is solved by the method for producing a corrosion-resistant aluminum-silicon alloy casting described herein, and a corrosion-resistant aluminum-silicon casting described herein. Uses of the corrosion-resistant casting according to the invention and preferred embodiments are also described.

It is provided a corrosion-resistant aluminum-silicon alloy substrate having an uniform aluminum oxide film with an average thickness from 4 to 90 μm as corrosion-protection layer. The aluminum-silicon alloy in the context of the present invention comprises aluminum and silicon, but can comprise further metals as Magnesium, Iron, Manganese, Titanium, Copper, Chromium, Zinc, Tin, Nickel, Lead, Silver, Beryllium, Bismuth, Lithium, Cadmium, Zirconium, Vanadiumn Scandium and combinations thereof. Moreover, the alloy can comprise other impurities of up to 0.1 wt.-%.

In order to solve this problem the invention proposes a method for producing a corrosion-resistant aluminum-silicon alloy casting with the following steps:

a) Providing an aluminum-silicon alloy casting and
b) growing a corrosion-protection layer at least partially on the surface of the aluminum-silicon alloy casting with a multi-step anodizing process having
   b1) a first step of pre-anodization for oxidizing aluminum at the surface of the casting at a voltage of 1 to 40 V;
   b2) a second anodization step for oxidizing aluminum and silicon at the surface of the casting at a voltage of 20 to 50 V.

The voltage of the second anodization step of the process is higher than the voltage of the first step of pre-anodization.

By using this technique, the film has a higher thickness and the process can be shortened up to 80 percent due to activation of silicon secondary phases, which in classical anodizing act as a inhibitor slowing down or stopping the oxidation. This leads to a shorter process time by using this technique.

A denser and higher thickness film also combined with a seal layer provides not only a superior corrosion resistance but also a more uniform layer, which is esthetically more suitable with no zero spots. A zero spot is a zone of the aluminum alloy with no aluminum oxide film on the surface after anodization. Theses spots are caused by the presence in the aluminum alloy of silicon intermetallics which do not oxidizes at a low voltage that are more suitable for aluminum.

In a more specific embodiment of the invention, the voltage applied during the first step is from 5 to 30V, preferably from 10 to 20V, preferably with a duration of the first step of 2 to 8 minutes. The first step is conducted preferably at a temperature from 1 to 50° C., more preferably at a temperature from 5 to 30° C., and most preferably at a temperature from 10 to 20° C.

In a more specific embodiment of the invention, the voltage applied during the second step is from 25 to 40V, preferably with a duration of the second step of 2 minutes to 20 minutes. The second step is conducted preferably at a temperature from 1 to 50° C., more preferably at a temperature from 5 to 30° C., and most preferably at a temperature from 10 to 20° C.

In a more specific embodiment of the invention, those two steps are conducted in an acidic bath with different organic additives. In other words, the bath stays the same in those two steps despite the difference in organic additives, i.e. the container in which the bath is present stays the same. Since there is no need to prepare two different baths (containers) on an industrial line, the process according to this embodiment saves time and costs.

In a more specific embodiment of the invention, the acidic bath comprises sulfuric acid, wherein the concentration of sulfuric acid in the bath is preferably from 50 g/L to 250 g/L, more preferably from 100 g/L to 200 g/L, and most preferably from 150 g/L to 190 g/L.

In another embodiment of the invention, the first step of pre-anodization is preceded by a desmutting step in which an aluminum alloy is exposed to an acid. Desmutting is the action of chemistry for removal of pre-treatment residues (smuts) coming from attack of alloy intermetallic species without necessarily significant attack on the aluminum itself.

In a more specific embodiment of the invention, the acid is selected from the group consisting of nitric acid, phosphoric acid, sulfuric acid, fluoride containing acidic media and any organic acid, their combinations not limited to any catalyst such as hydrogen peroxide or persulfate or iron sulfate.

In a more specific embodiment of the invention, the duration of the desmutting step is from 0.1 to 40 minutes, preferably from 0.5 to 20 minutes, more preferably from 0.8 to 10 minutes.

In another embodiment of the invention, the desmutting step is preceded by an acidic pre-treatment step comprising contacting an aluminum alloy with an acid. The duration of the acidic pre-treatment step is preferably from 1 to 40 minutes, more preferably from 2 to 20 minutes, and most preferably from 3 to 10 minutes. The acidic pre-treatment step is conducted preferably at a temperature from 60 to 120° C., more preferably at a temperature from 70 to 100° C., and most preferably at a temperature from 80 to 95° C.

In a more specific embodiment of the invention, the acidic pre-treatment step is conducted at a pH lower than 6, preferably lower than 4 and more preferably lower than 2.

In another embodiment of the invention, the acidic pre-treatment step is preceded by a degreasing step in which an aluminum alloy is exposed to a cleaning agent. The cleaning agent is preferably an alkaline, acidic or solvent based cleaning agent, more preferably an acidic based cleaning agent. The duration of the degreasing step is preferably from 1 to 40 minutes, more preferably from 2 to 20 minutes, most preferably from 3 to 15 minutes. Moreover, the degreasing step is conducted preferably at a temperature from 30 to 80° C., more preferably at a temperature from 40° C. to 70° C., most preferably at a temperature from 50° C. to 65° C.

In another embodiment of the invention, the second step of anodization is followed by a sealing process comprising at least one of the following sealing processes A), B) and C):

A) Hot seal in which the anodized aluminum-silicon alloy casting is exposed to water with a temperature of 90 to 100° C. and/or at least one surfactant to remove smut B) Medium temperature seal in which the anodized aluminum-silicon alloy casting is exposed to any organic agents or metal salts to improve the sealing quality such as nickel acetate or magnesium acetate C) Cold seal comprising the following steps:

1. a first step of cold sealing in which the anodized aluminum-silicon alloy casting is exposed to a metal salt selected from the group of a Nickel salt and/or a Magnesium salt and/or a Chromium salt and/or a Zirconium salt, preferably a Nickel fluoride and/or Nickel acetate and/or a triva-lent Chrome and/or a Zirconium salt and/or Magnesium acetate and/or Lithium hydroxide, more preferably a Nickel fluoride and/or Nickel acetate, and at least one surfactant and
2. a second step of aging in which the anodized aluminum-silicon alloy casting is exposed to deionized water or with at least one surfactant to remove any smut formed on the surface In a more specific embodiment of the invention, the duration of the hot sealing is from 10 to 50 minutes, preferably from 20 to 40 minutes, more preferably from 25 to 35 minutes. It is preferred that the hot sealing is effected at a temperature from 80 to 130° C., more preferably at a temperature from 85 to 120° C., and most preferably at a temperature from 90 to 110° C. Preferably, the hot sealing is conducted at a pH of 4 to 7, more preferably at a pH of 5 to 6.5.

In a more specific embodiment of the invention, the duration of the first step of the cold sealing is from 5 to 40 minutes, preferably from 10 to 30 minutes, more preferably from 15 to 25 minutes. The first step of the cold sealing is preferably conducted at a temperature from 10 to 50° C., more preferably at a temperature from 15 to 40° C., and most preferably at a temperature from 20 to 30° C. It is preferred that the first step of the cold sealing is conducted at a pH of 5 to 7, more preferably of 5.5 to 6.5.

In a more specific embodiment of the invention, the duration of the aging step (second step) is from 1 to 30 minutes, preferably from 2 to 20 minutes, more preferably from 5 to 15 minutes, wherein the aging step is preferably conducted at a temperature from 50 to 100° C., more preferably at a temperature from 60 to 90° C., and most preferably at a temperature from 65 to 85° C.

In a preferred embodiment of the invention, the aluminum film oxide is obtained by a multi-step anodizing process comprising at least one and more preferably all of the following steps:

a) a degreasing step, b) an acidic pre-treatment step, c) a desmutting step, d) a pre-anodization step for oxidizing aluminum at the surface of the casting at a voltage of 1 to 40 V, e) an second anodization step for oxidizing aluminum and silicon at the surface of the casting at a voltage of 20 to 50 V, wherein the voltage of the second anodization step of the process is higher than the voltage of the first step of pre-anodization, f) a cold sealing step, and g) an aging step.

Moreover, a corrosion-resistant aluminum-silicon alloy casting having an aluminum oxide film with an average thickness from 4 to 90 μm as corrosion-protection layer.

The percentage of zero spots is determined by the observation of 1 $cm^2$ of the surface of the aluminum oxide with optical microscopy. Subsequently, the surface of zero spots is determined and compared to the total surface observed to obtain the percentage of zero spots.

Furthermore, by using a pre-anodization and lowering the general conductivity the risk of electrical break down at higher current densities is also lessened, increasing the productivity and lowering the re-work percentage.

In a more specific embodiment of the invention, the aluminum oxide film has an average thickness from 1 to 90 μm, preferably from 5 to 70 μm, more preferably from 10 to 50 μm.

The film thickness is determined as per DIN EN ISO 1463. The average film thickness is calculated with an adequate number of measuring points on a cross-section. At least three localized individual measured values on the cross-section must be used for each measuring point.

In a more specific embodiment of the invention, the aluminum oxide film has a ratio between the average highest coating thickness and the average lowest coating thickness of 8:1, preferably a ratio of 6:1, more preferably a ratio of 4:1.

This ratio is calculated by taking an image of a cross section of 300 μm by SEM 250×. Then three points with the highest coating thickness and three points with the lowest coating thickness can be determined and their thickness is measured. Subsequently, it is possible to calculate the average highest coating thickness and the average lowest coating thickness.

In a more specific embodiment of the invention, the surface of the substrate is substantially free of zero spots which means that the coverage of the surface by the oxide is above 88%, preferably above 92%, more preferably completely free of zero spots, wherein the zero spots have preferably a maximum width of 60 μm.

The coverage and zero spot measurement are determined according to the norm TL 212 Issue 2016-12 from Volkswagen. The coverage rate of the surface is determined by a percentage of the examined measurement length. The zero-point width in the microsection must not exceed 60 μm.

In a more specific embodiment of the invention, the aluminum oxide film has a maximum pure silicon concentration of 5 wt.-%, preferably from 0.5 to 2 wt.-%.

In a more specific embodiment of the invention, the Si—O to Si ratio in the aluminum oxide film is not below 60%.

In a more specific embodiment of the invention, corrosion-resistant aluminium-silicon alloy casting (i.e. the casting coated with the aluminium oxide film) can be characterized by its L, a, b values obtained using optical Spectrophotometry. Those L, a, b values are comprised between 49 to 65 for L, −0.7 to −0.1 for a and 1.7 to 4 for b, preferably 52 to 60 for L, −0.5 to −0.3 for a and 1.8 to 3.8 for b.

The L, a, b values are determined as per BS EN ISO 6719 and BN EN ISO 11664-4.

In a more specific embodiment of the invention, the aluminum alloy comprises from 0.5 to 70 wt.-% of silicon, preferably from 5 to 20 wt.-%, more preferably from 6 to 15 wt.-%.

In a more specific embodiment of the invention, the aluminum alloy comprises further metals selected from the group consisting of Magnesium, Iron, Manganese, Titanium, Copper, Chromium, Zinc, Tin, Nickel, Lead, Silver, Beryllium, Bismuth, Lithium, Cadmium, Zirconium, Vanadium, Scandium and combinations thereof, preferably Magnesium, Iron, Manganese, Titanium, Copper, Chromium, more preferably Magnesium, Iron.

In a more specific embodiment of the invention, the aluminum alloy is $AlSi_7Mg$ Alloy, $AlSi_{10}$ Alloy and $AlSi_{12}$ (Fe) Alloy.

The corrosion-resistant aluminum-silicon alloy casting is preferably obtainable by the method as described above.

With reference to the following figures and examples, the subject-matter according to the present invention is intended to be explained in more detail without wishing to restrict said subject-matter to the specific embodiments shown here.

FIG. 1 shows OM 200× cross section images of a surface produced by a classical anodization process (FIG. 1*a*) and a surface obtained by using double a step anodization process (FIG. 1*b*). On the surface of sample of the sample FIG. 1 *a*), which was produced by classical anodization process, zero spot can be seen. However, on the surface of the sample of FIG. 1 *b*), which was obtained by using double step anodization, homogeneous and zero spot free anodic oxide layer is seen. High silicon concentration may prevent anodic oxide formation locally. The zone that is not covered by the oxide layer with zero spots should not affect coating properties, which is only possible with minimum 85% oxide coverage.

Figure 2:
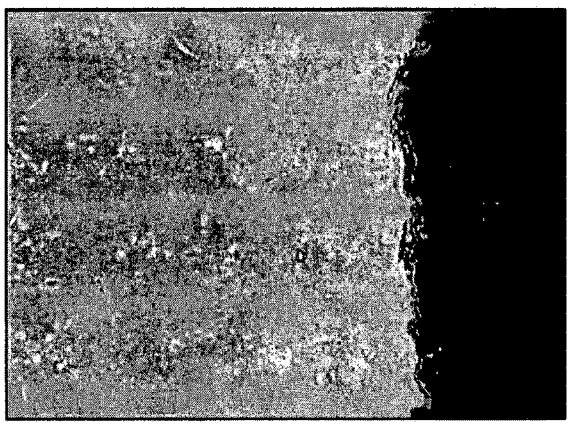
Figure 2:
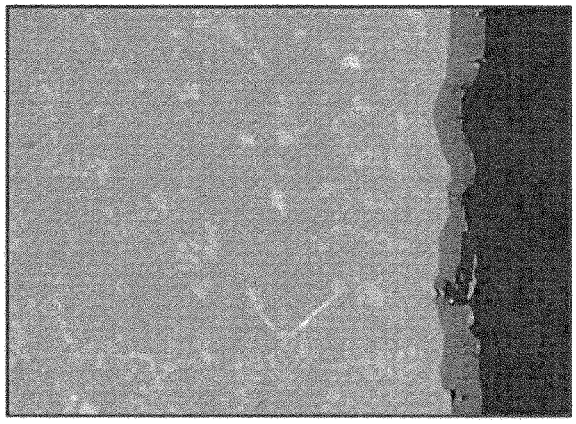
Figure 2:
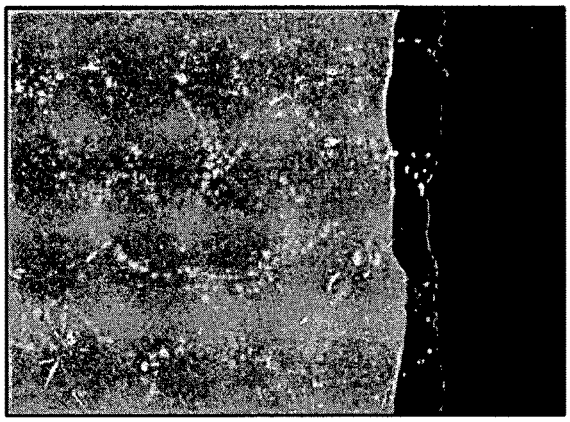
Figure 2:
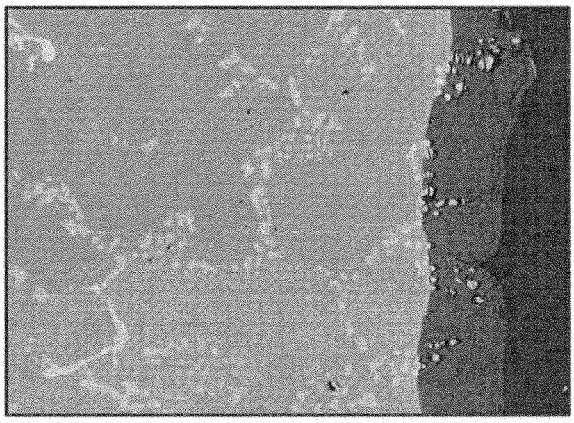

FIG. 2 shows SEM SEI 500× cross section images of a sample A as control group (FIG. 2*a*), a sample B which was anodized with sulfuric acid and proprietary organic anodizing additive (FIG. 2*b*), a sample C which was pretreated for 4 minutes and anodized with sulfuric acid and proprietary organic anodizing additive (FIG. 2*c*) and a sample D which was pretreated for 10 minutes and anodized with sulfuric acid and proprietary organic anodizing additive (FIG. 2*d*).

Figure 3:
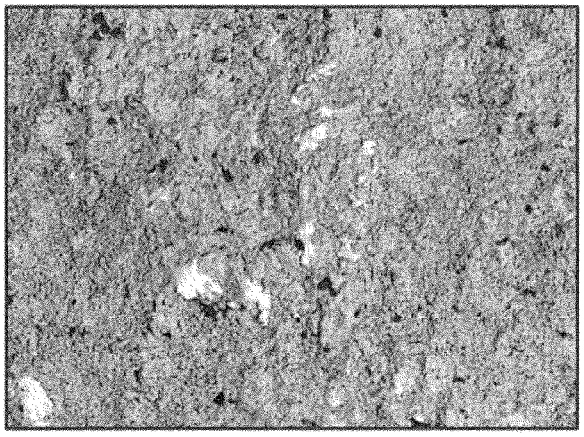
Figure 3:
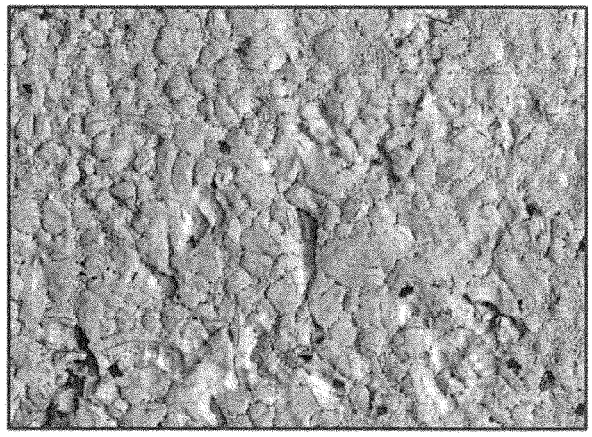
Figure 3:
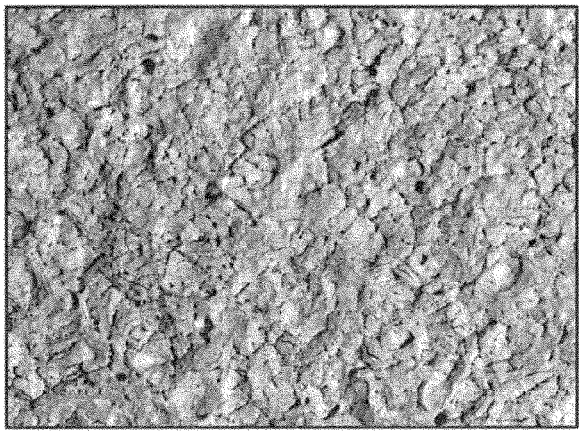
Figure 3:
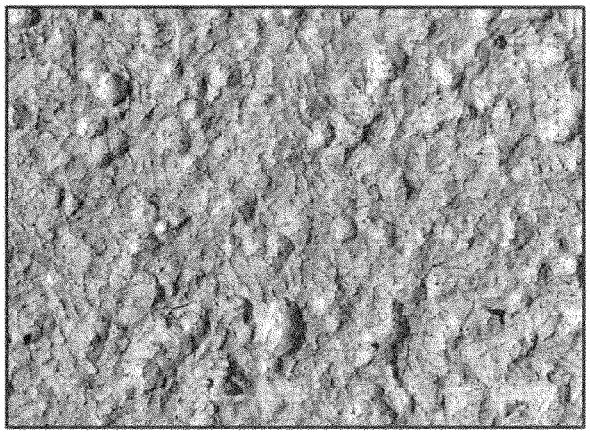

FIG. 3 shows SEM SEI 500× surface images of a sample A as control group (FIG. 3*a*), a sample B which was anodized with sulfuric acid and proprietary organic anodizing additive (FIG. 3*b*), a sample C pretreated for 4 minutes and anodized with sulfuric acid and proprietary organic anodizing additive (FIG. 3*c*) and a sample D pretreated for 10 minutes and anodized with sulfuric acid and proprietary organic anodizing additive (FIG. 3*d*).

Figure 4:
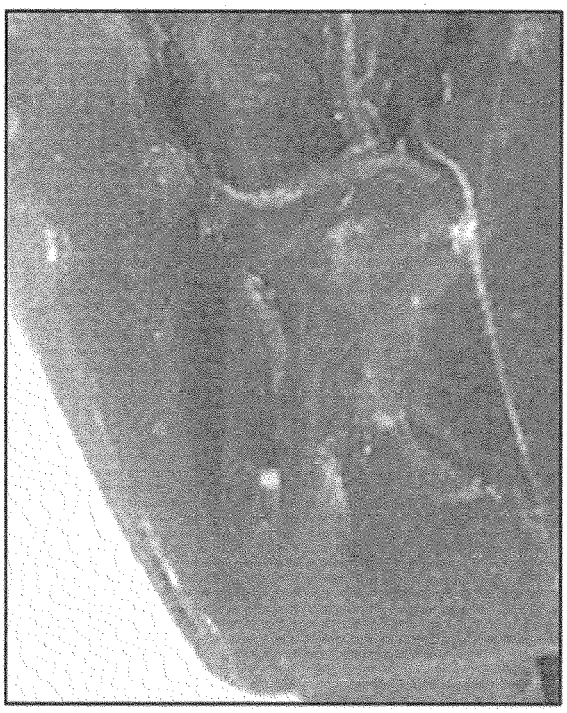
Figure 4:
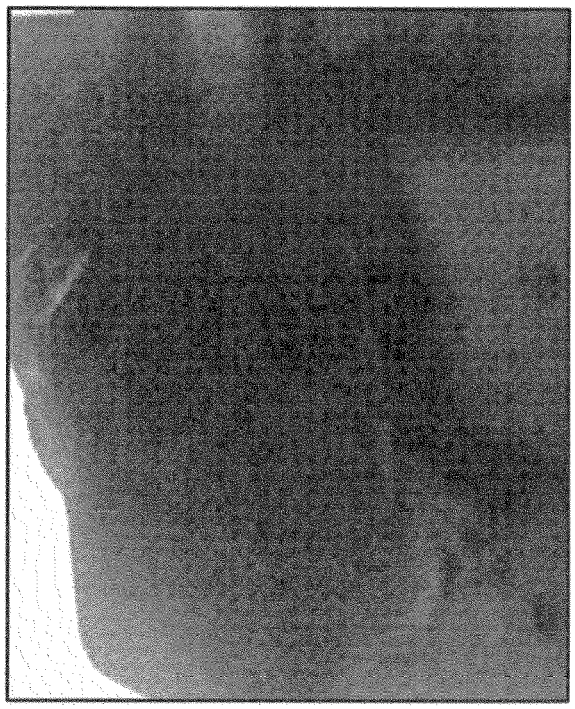
Figure 4:
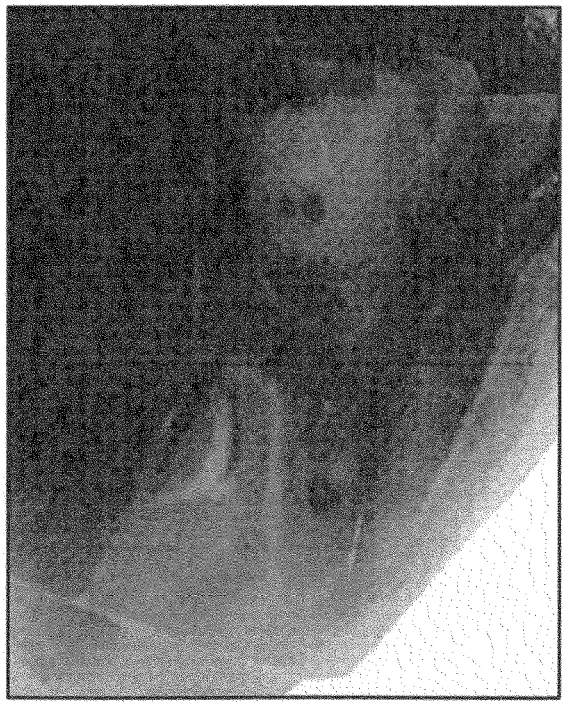
Figure 4:
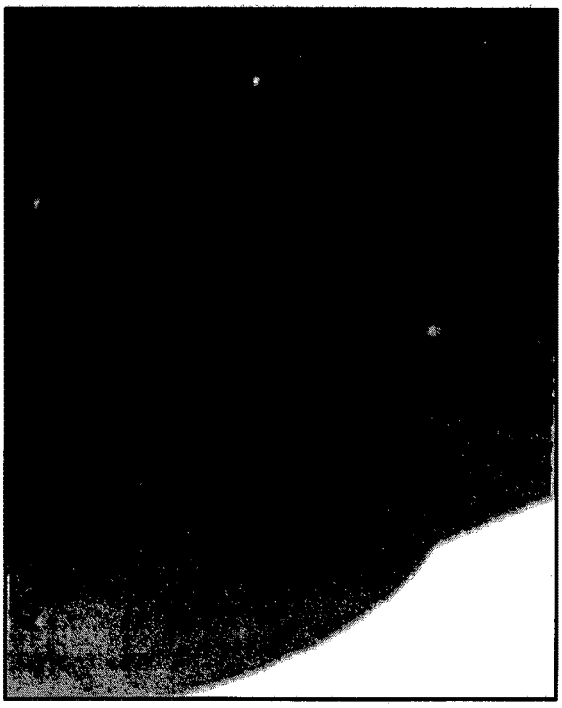

FIG. 4 shows NSS results of Samples A, B, C and D after subjecting to NSS for 480 hours according to ISO 9227

EXAMPLES

1. Sample Preparation

The cast aluminum alloys $AlSi_7Mg$, $AlSi_{10}$ and $AlSi_{12}$(Fe) samples were cut to size 5×5 inches and degreased by using standard propriety chemicals available in the industry. The first set of samples were anodized using direct current in an acid based bath with different organic additives.

Degreasing is conducted in Alumal Clean 118 L containing mainly surface active agents for cleaning at 40 g/L. Acidic pretreatment is conducted with e.g pure phosphoric acid at 100% (concentrated). Desmuting is conducted in Nitric acid in 250 g/I. The acidic bath for anodization is composed of Sulfuric acid at a concentration of 200 g/I and the organic additives Alumal Elox 557 in concentration of 30 g/L.

After anodizing only the samples chosen for the NSS test were colored black at 66° C. for 15 minutes. The samples for surface investigation studies were put directly to nickel fluoride at a concentration of 6 g/Land a pH=5.9 cold seal process followed by a warm rinse bath with deionized water with a conductivity of 25 micro Siemens. The results have been repeated 3 times to show the repeatability.

Finally an alternative acidic pretreatment was developed to improve the aluminum oxide film properties.

The aluminum oxide film was characterized with Optical Microscopy (OM) and Scanning Electron Microscopy with Energy Dispersive Spectroscopy (SEM/EDS) and spectrophotometry and XPS. The corrosion resistance was examined by using Natural Salt Spray (NSS).

The L, a, b values were measured on a Shimadzu UV-2600 Spectrometer and the measurement wavelength was comprised between 220 and 1400 nm. Then the software COL-UVPC Color Measurement Software calculates the color values of the measured object from the spectra obtained by the spectrophotometer.

To show the negative effect of the silicon intermetallics standard anodized samples were investigated with OM under polarized light, and SEM/EDS. For cross section examination the samples were cut with precision cutter, polished and finally molded with cold resin. For cross section SEM studies the prepared samples were also sputtered with Au for at least 20 seconds to prevent any charge build up. Finally NSS was applied all the black dyed parts according to ISO 9227:2017 standard for a maximum of 480 hours and the first initiation of the corrosion as well as fading of the color was reported.

The different conditions used with the samples have been listed in Table 1 to 3 below.

TABLE 1

Process sequence for the Samples of the examples according to the invention (AlSi7Mg Alloy)
AlSi7Mg Alloy

| Sample | Degreasing | Acidic Pretreatement | Desmutting | Pre-anodization |
|---|---|---|---|---|
| A | 15 min at 65° C. | — | — | — |
| B | 15 min at 65° C. | — | — | — |
| C | 15 min at 65° C. | — | — | 5 min at 16 V at 15-18° C. |
| D | 15 min at 65° C. | 4 min at 91° C. | 2 min at 35° C. | 5 min at 16 V at 15-18° C. |
| E | 15 min at 65° C. | 4 min at 91° C. | 2 min at 35° C. | 5 min at 16 V at 15-18° C. |
| F | 5 min at 55-60° C. | — | 1 min at 35° C. | 5 min at 16 V at 15-18° C. |
| G | 5 min at 55-60° C. | 7 min at 85-90° C. | 1 min at 35° C. | 5 min at 16 V at 15-18° C. |
| H | 5 min at 55-60° C. | 3 min at 85-90° C. | 1 min at 35° C. | 5 min at 16 V at 15-18° C. |
| I | 5 min at 55-60° C. | 5 min at 85-90° C. | 1 min at 35° C. | 5 min at 16 V at 15-18° C. |
| J | 5 min at 55-60° C. | 10 min at 85-90° C. | 1 min at 35° C. | 5 min at 16 V at 15-18° C. |
| K | 5 min at 55-60° C. | 10 min at 85-90° C. | 1 min at 35° C. | 5 min at 20 V at 15-18° C. |
| L | 5 min at 55-60° C. | 10 min at 85-90° C. | 1 min at 35° C. | 5 min at 20 V at 15-18° C. |
| M | 5 min at 55-60° C. | 10 min at 85-90° C. | 1 min at 35° C. | 5 min at 20 V at 15-18° C. |

| Sample | Anodization | Sealing | Thickness |
|---|---|---|---|
| A | 10 min at 30 V at 15-18° C. | Cold seal 15 min at 35° C.<br>Warm rinse 15 min at 66° C. | 3 μm |
| B | 30 min at 30 V at 15-18° C. | Cold seal 15 min at 35° C.<br>Warm rinse 15 min at 66° C. | 20 μm |
| C | 15 min at 30 V at 15-18° C. | Cold seal 15 min at 35° C.<br>Warm rinse 15 min at 66° C. | 9 μm |
| D | 15 min at 30 V at 15-18° C. | Cold seal 15 min at 35° C.<br>Warm rinse 15 min at 66° C. | 30 μm |
| E | 15 min at 30 V at 15-18° C. | Cold seal 15 min at 35° C.<br>Warm rinse 15 min at 66° C. | 45 μm |
| F | 10 min at 30 V at 15-18° C. | Cold seal 20 min at 35° C.<br>Warm rinse 10 min at 70-80° C. | 22 μm |
| G | 5 min at 30 V at 15-18° C. | Cold seal 20 min at 35° C.<br>Warm rinse 10 min at 70-80° C. | 23 μm |
| H | 10 min at 30 V at 15-18° C. | Cold seal 20 min at 35° C.<br>Warm rinse 10 min at 70-80° C. | 36 μm |
| I | 20 min at 30 V at 15-18° C. | Cold seal 20 min at 35° C.<br>Warm rinse 10 min at 70-80° C. | 48 μm |
| J | 5 min at 30 V at 15-18° C. | Cold seal 20 min at 35° C.<br>Warm rinse 10 min at 70-80° C. | 23 μm |
| K | 5 min at 30 V at 15-18° C. | Cold seal 20 min at 35° C.<br>Warm rinse 10 min at 70-80° C. | 20 μm |
| L | 10 min at 30 V at 15-18° C. | Cold seal 20 min at 35° C.<br>Warm rinse 10 min at 70-80° C. | 35 μm |
| M | 20 min at 30 V at 15-18° C. | Cold seal 20 min at 35° C.<br>Warm rinse 10 min at 70-80° C. | 50 μm |

TABLE 2

Process sequence for the samples of the examples according to the invention (AlSi10 alloy)
AlSi10 alloy

| Sample | Degreasing | Acidic Pre-treatement | Desmutting | Pre-anodization |
|---|---|---|---|---|
| N | 5 min at 55-60° C. | — | — | — |
| O | 5 min at 55-60° C. | 3 min at 85-90° C. | 1 min at 35° C. | 5 min at 16 V at 15-18° C. |
| P | 5 min at 55-60° C. | 5 min at 85-90° C. | 1 min at 35° C. | 5 min at 16 V at 15-18° C. |
| R | 15 min at 55-60° C. | 3 min at 85-90° C. | 1 min at 35° C. | 5 min at 16 V at 15-18° C. |
| S | 15 min at 55-60° C. | 5 min at 85-90° C. | 1 min at 35° C. | 5 min at 16 V at 15-18° C. |
| T | 5 min at 55-60° C. | 5 min at 85-90° C. | 1 min at 35° C. | 5 min at 20 V at 15-18° C. |
| U | 5 min at 55-60° C. | 5 min at 85-90° C. | 1 min at 35° C. | 5 min at 20 V at 15-18° C. |

| Sample | Anodization | Sealing | Thickness |
|---|---|---|---|
| N | 40 min at 30 V at 15-18° C. | Cold seal 20 min at 35° C.<br>Warm rinse 10 min at 70-80° C. | 20 |
| O | 10 min at 30 V at 15-18° C. | Cold seal 20 min at 35° C.<br>Warm rinse 10 min at 70-80° C. | 24 μm |
| P | 20 min at 30 V at 15-18° C. | Cold seal 20 min at 35° C.<br>Warm rinse 10 min at 70-80° C. | 29 μm |
| R | 10 min at 30 V at 15-18° C. | Cold seal 20 min at 35° C.<br>Warm rinse 10 min at 70-80° C. | 22 |
| S | 20 min at 30 V at 15-18° C. | Cold seal 20 min at 35° C.<br>Warm rinse 10 min at 70-80° C. | 26 |
| T | 10 min at 30 V at 15-18° C. | Cold seal 20 min at 35° C.<br>Warm rinse 10 min at 70-80° C. | 25 |
| U | 20 min at 30 V at 15-18° C. | Cold seal 20 min at 35° C.<br>Warm rinse 10 min at 70-80° C. | 35 |

TABLE 3

Process sequence for the samples of the examples according to the invention (AlSi12(Fe) alloy)
AlSi12(Fe) alloy

| Sample | Degreasing | Acidic Pre-treatement | Desmutting | Pre-anodization |
|---|---|---|---|---|
| V | 5 min at 55-60° C. | — | — | — |
| W | 5 min at 55-60° C. | — | 1 min at 35° C. | 5 min at 16 V at 15-18° C. |
| X | 5 min at 55-60° C. | — | 1 min at 35° C. | 5 min at 16 V at 15-18° C. |
| Y | 5 min at 55-60° C. | 3 min at 85-90° C. | 1 min at 35° C. | 5 min at 16 V at 15-18° C. |
| Z | 5 min at 55-60° C. | 5 min at 85-90° C. | 1 min at 35° C. | 5 min at 16 V at 15-18° C. |
| AA | 5 min at 55-60° C. | 5 min at 85-90° C. | 1 min at 35° C. | 5 min at 16 V at 15-18° C. |
| BB | 5 min at 55-60° C. | 10 min at 85-90° C. | 1 min at 35° C. | 5 min at 16 V at 15-18° C. |

| Sample | Anodization | Sealing | Thickness |
|---|---|---|---|
| V | 50 min at 30 V at 15-18° C. | Cold seal 20 min at 35° C.<br>Warm rinse 10 min at 70-80° C. | 15 μm |
| W | 10 min at 30 V at 15-18° C. | Cold seal 20 min at 35° C.<br>Warm rinse 10 min at 70-80° C. | 14 μm |
| X | 20 min at 30 V at 15-18° C. | Cold seal 20 min at 35° C.<br>Warm rinse 10 min at 70-80° C. | 19 μm |
| Y | 10 min at 30 V at 15-18° C. | Cold seal 20 min at 35° C.<br>Warm rinse 10 min at 70-80° C. | 15 μm |
| Z | 20 min at 30 V at 15-18° C. | Cold seal 20 min at 35° C.<br>Warm rinse 10 min at 70-80° C. | 18 μm |
| AA | 20 min at 20 V at 15-18° C. | Cold seal 20 min at 35° C.<br>Warm rinse 10 min at 70-80° C. | 13 μm |
| BB | 5 min at 30 V at 15-18° C. | Cold seal 20 min at 35° C.<br>Warm rinse 10 min at 70-80° C. | 11 μm |

2. Sample Characterization

The sample A is used as the control sample in comparison to samples B, C and D. The properties of aluminum oxide film were investigated by using SEM cross section and surface analysis as presented in FIGS. 2 and 3.

FIGS. 2 *a*) and 3 *a*) are taken from a classical anodizing done which belongs to Sample A. The detrimental effect of the Si due to their relatively inert nature the aluminum oxide film growth on the high silicon containing zones are dampened thus causing discontinuous and very thin (up to 0.15 to 0.2 mils) oxide layer.

By using a two-step anodizing process, the second sample set Sample B was produced with the same parameters as the control group Sample A. As it can be seen from the FIG. 2 *b*) compared to the FIG. 2 *a*), the oxide growth has a higher thickness up to 0.47 mils. Furthermore, the increased thickness also counter acts with the inhibiting effect of the silicon intermetallics as can be seen from the surface SEM image in FIG. 3 *b*), resulting in a continuous aluminum oxide film, where the silicon secondary phases are trapped in/on the oxide film.

The pretreatment allows to further improve the oxide layer thickness from 0.98 mils up to 1.37 mils with a denser coating on the surface as can be seen from the FIGS. 2 *c*) and *d*). The surface images also reveal an enhanced continuity of the layer with the silicon particles mostly embedded into the aluminum oxide film showing much less cracks than the Sample B in FIG. 3 *b*). Comparing the images from FIGS. 2 and 3 of Sample C and D where the pretreatment time is increased from 4 minutes to 10 minutes no significant improvement on the layer thickness and/or integrity have been observed. However looking at the surface images from the FIG. 3 it can be said that due to the brightening effect of the pretreatment the 10 minutes option has a smoother appearance.

The samples B, F, J, K, L, N, O, R, V, W, Y were used to measure the L, a, b values of the aluminum casting obtained by the process. Those values can be found on the Table 4 and Table 5 below with the color obtained for each sample.

TABLE 4

L, a, b values for sample J, K, L, N, O, R, V, W and Y

| Sample Code | L | a | b |
|---|---|---|---|
| Sample J | 56.26 | −0.48 | 3.74 |
| Sample K | 53.55 | −0.39 | 3.26 |
| Sample L | 49.66 | −0.45 | 3.82 |
| Sample N | 51.05 | −0.43 | 3.91 |
| Sample O | 57.12 | −0.39 | 3.12 |
| Sample R | 58.24 | −0.40 | 3.15 |
| Sample V | 51.02 | −0.34 | 3.33 |
| Sample W | 53.06 | −0.31 | 3.27 |
| Sample Y | 53.86 | −0.37 | 3.87 |

TABLE 5

L, a, b values for gold colored samples (sample B and F)

| Sample Code | L | a | b |
|---|---|---|---|
| Sample B | 52.13 | 2.12 | 33.78 |
| Sample F | 67.66 | 2.06 | 34.61 |

The final color of the cast aluminum oxide layer depends on base metal gloss and color. Clear anodic oxide color is the primary condition of obtaining durable and aesthetically appealing final color. Color comparison of classically anodized and double anodized samples are given in Table 5. Samples were anodized by using different anodization parameters and colored in the inorganic gold dye. By using double anodization, more vivid and clear color can be obtained.

3. Determination of Corrosion Resistance

In order to determine the contribution of different surface treatments on the corrosion resistance samples were subjected to NSS tests. To be able to see the corrosion spots more clearly and also observe the effect of this test on the color fade, the samples were dye colored in black.

The results from the NSS test (shown in Table 6) are in agreement with the SEM observations, the best corrosion behavior was achieved for the Samples C and D as expected. For sample B, although no corrosion sign was detected, presence of color change indicated the important role of oxide film thickness on color integrity.

TABLE 6

NSS results of Sample A, B, C and D after 480 hours according to ISO 9227

| Sample Code | Result/Comment |
|---|---|
| Sample A | Base metal corrosion, and color change was observed |
| Sample B | No base metal corrosion, color change was observed |
| Sample C | No base metal corrosion and no color change was observed |
| Sample D | No base metal corrosion and no color change was observed |

Due to the good performance of Sample C and D after 480 hours of NSS, larger area samples have been produced to repeat the test to see where the first sign of corrosion and/or color fading will start.

The invention claimed is:

1. A corrosion-resistant aluminum-silicon alloy casting having an aluminum oxide film with an average thickness from 4 to 90 μm as a corrosion protection layer, wherein the aluminum oxide film has a ratio between the average highest coating thickness and the average lowest coating thickness of 8:1 or less, wherein the ratio is calculated by taking an image of a cross section of 300 μm by SEM 250×, determining three points with the highest coating thickness and three points with the lowest coating thickness and measuring their thickness, and calculating the average highest coating thickness and the average lowest coating thickness, wherein the corrosion-resistant aluminum-silicon alloy casting is substantially free of zero spots such that coverage of a surface of the corrosion-resistant aluminum-silicon alloy casting by the aluminum oxide film is above 88%, wherein the coverage and zero spot measurements are determined according to Standard TL 212 Issue 2016-12 from Volkswagen, wherein the coverage of the surface of the corrosion-resistant aluminum-silicon alloy casting is determined by a percentage of an examined measurement length and wherein a zero-point width in a microsection must not exceed 60 μm, and wherein the corrosion-resistant aluminum-silicon alloy casting comprises from 5 to 70 wt. % of silicon.

2. The corrosion-resistant aluminum-silicon alloy casting according to claim 1, wherein the aluminum oxide film has an average thickness of 5 to 90 μm.

3. The corrosion-resistant aluminum-silicon alloy casting according to claim 1, wherein the aluminum oxide film has a ratio between the average highest coating thickness and the average lowest coating thickness in the range of 8:1 to 4:1.

4. The corrosion-resistant aluminum-silicon alloy casting according to claim 1, wherein the surface of the corrosion-resistant aluminum-silicon alloy casting is completely free of zero spots.

5. The corrosion-resistant aluminum-silicon alloy casting according to claim 1, wherein the corrosion-resistant aluminum-silicon alloy casting aluminum oxide film has L, a, b values of 49 to 65 for L, −0.7 to −0.1 for a, and 1.7 to 4 for b.

6. The corrosion-resistant aluminum-silicon alloy casting according to claim 1, wherein the aluminum oxide film has a maximum pure silicon concentration of 5 wt. %.

7. The corrosion-resistant aluminum-silicon alloy casting according to claim 1, wherein the corrosion-resistant aluminum-silicon alloy casting comprises from 0.5 wt. % to 70 wt. % silicon.

8. The corrosion-resistant aluminum-silicon alloy casting according to claim 1, wherein the corrosion-resistant aluminum-silicon alloy casting comprises further a metal selected from the group consisting of magnesium, iron, manganese, titanium, copper, chromium, zinc, tin, nickel, lead, silver, beryllium, bismuth, lithium, cadmium, zirconium, vanadium, scandium, and combinations thereof.

9. The corrosion-resistant resistant aluminum-silicon alloy casting according to claim 1, wherein the corrosion-resistant aluminum-silicon alloy casting comprises an $AlSi_7Mg$ alloy, an $AlSi_{10}$ alloy, an $AlSi_{12}(Fe)$ alloy, or a combination thereof.

10. An automotive part, aerospace part, or an appliance part prepared from the corrosion-resistant aluminum-silicon alloy casting of claim 1.

11. The corrosion-resistant aluminum-silicon alloy casting according to claim 1, wherein the aluminum oxide film has a ratio between the average highest coating thickness and the average lowest coating thickness of about 4:1.

12. The corrosion-resistant aluminum-silicon alloy casting according to claim 1, wherein the aluminum oxide film has a ratio between the average highest coating thickness and the average lowest coating thickness of 4:1.

13. A method for producing a corrosion-resistant aluminum-silicon alloy casting comprising:

(a) providing an aluminum-silicon alloy casting and (b) growing a corrosion-protection layer at least partially on the surface of the aluminum-silicon alloy casting with a multi-step anodizing process comprising:

(b1) a first step of pre-anodization for oxidizing aluminum at the surface of the casting at a voltage of 1 to 40 V; and (b2) a second step of anodization for oxidizing aluminum and silicon at the surface of the casting at a voltage of 25 to 50 V, wherein the voltage of the second step (b2) is higher than the voltage of the first step (b1) and wherein the first step (b1) and the second step (b2) are conducted in an acidic bath with different organic additives.

14. The method according to claim 13, wherein the voltage applied during the first step (b1) is from 5 to 30 V and/or the voltage applied during the second step (b2) is from 25 to 40 V.

15. The method according to claim 13, wherein the first step (b1) is conducted at a temperature from 1 to 50° C. and/or the second step (b2) is conducted at a temperature from 1 to 50° C.

16. The method according to claim 13, wherein the two steps are conducted in an acidic bath comprising sulfuric acid.

17. The method according to claim 16, wherein the concentration of sulfuric acid is from 50 to 250 g/L.

18. The method according to claim 13, wherein the organic additives are selected from the group consisting of oxalic acid, tartaric acid, glycolic acid, ethylene glycol, and combinations thereof.

19. The method according to claim 13, wherein the first step (b1) of pre-anodization is preceded by at least one of the following pre-treatment steps:

a. a desmutting step in which the aluminum-silicon alloy casting is exposed to an acid, b. an acidic pre-treatment step in which the aluminum-silicon alloy casting is exposed to an acid, and/or c. a degreasing step in which the aluminum-silicon alloy casting is exposed to a cleaning agent.

20. The method according to claim 13, wherein the second step (b2) is followed by a sealing process.

21. The method according to claim 20, wherein the sealing process is selected from one of the following processes:

a. hot sealing in which the anodized aluminum alloy is exposed to water with a temperature of 90 to 100° C. and/or surface active agents to remove smut;

b. medium temperature sealing in which the anodized aluminum alloy is exposed to any organic agents or metal salts to improve the sealing quality such as nickel acetate or magnesium acetate; and/or c. cold sealing with a first sealing step in which the anodized aluminum alloy casting is exposed to a metal salt selected from the group consisting of a nickel salt, a magnesium salt, a chromium salt, and a zirconium salt, and at least one surfactant and a second aging step in which the anodized aluminum alloy is exposed to deionized water and/or at least one surfactant to remove any smut formed on the surface.

22. A corrosion-resistant aluminum-silicon alloy casting produced by the method of claim 13.

* * * * *